US012029315B1

(12) United States Patent
Meyer

(10) Patent No.: US 12,029,315 B1
(45) Date of Patent: Jul. 9, 2024

(54) WORKSPACE RISER FOR EXERCISE EQUIPMENT

(71) Applicant: CKnapp Sales, Inc., Goodfield, IL (US)

(72) Inventor: Brandon Meyer, Normal, IL (US)

(73) Assignee: CKnapp Sales, Inc., Goodfield, IL (US)

( * ) Notice: Subject to any disclaimer, the term of this patent is extended or adjusted under 35 U.S.C. 154(b) by 80 days.

(21) Appl. No.: 17/561,689

(22) Filed: Dec. 23, 2021

(51) Int. Cl.
*A47B 9/16* (2006.01)
*A47B 9/02* (2006.01)
*A63B 21/00* (2006.01)

(52) U.S. Cl.
CPC ..... *A47B 9/16* (2013.01); *A47B 9/02* (2013.01); *A63B 21/4035* (2015.10); *A63B 2225/68* (2013.01)

(58) Field of Classification Search
CPC .... A47B 9/16; A47B 9/02; A47B 3/02; A47B 2003/045; A47B 2003/025; A47B 21/0314; A47B 2200/0036; A47B 2200/0042; A47B 2200/06; A47B 9/00; A47B 2023/049; A47B 2220/06; A47B 23/02; A63B 21/4035; A63B 2225/68; A63B 22/02
USPC ..... 108/136, 145–147, 50.11, 116–120, 96, 108/42, 47, 50.14; 248/441.1
See application file for complete search history.

(56) References Cited

U.S. PATENT DOCUMENTS 572,226 A * 12/1896 Spiegel
3,134,192 A * 5/1964 Huffer ..... A47B 19/08 248/463
9,498,671 B1 * 11/2016 Softky ..... A63B 22/02
10,085,550 B1 * 10/2018 Hsu ..... A47B 9/16
10,092,089 B1 * 10/2018 Yuan ..... A47B 3/002
10,244,861 B1 4/2019 Poniatowski
(Continued)

FOREIGN PATENT DOCUMENTS

CN 207693190 * 8/2018
CN 106165968 * 5/2019
(Continued)

OTHER PUBLICATIONS

VIVO Laptop tray treadmill attachment; additional pages for Model TDML2 (Year: 2020).*
(Continued)

*Primary Examiner* — Janet M Wilkens
(74) *Attorney, Agent, or Firm* — Lund IP, PLLC

(57) ABSTRACT

An adjustable height workspace includes a base forming a bottom surface, a first handlebar mount on the bottom surface, a second handlebar mount on the bottom surface spaced from the first handlebar mount, a work surface platform, and a height adjustment mechanism connecting the work surface platform and the base. The height adjustment mechanism includes a set of pivot arms that connect at a scissoring pivot point creating a scissoring motion when raising and lowering the work surface platform to various heights, a base pivot point fixed relative to the base and connecting the first pivot arm to the base, a platform pivot point fixed relative to the work surface platform and connecting the second pivot arm to the work surface platform, a first sliding mechanism between a the first pivot arm and the work surface platform, and a second sliding mechanism between the second pivot arm and the base.

25 Claims, 8 Drawing Sheets

(56) References Cited

U.S. PATENT DOCUMENTS

| | | | | |
|---|---|---|---|---|
| 10,874,208 | B1 * | 12/2020 | Knapp | A63B 71/0622 |
| 2007/0069101 | A1 * | 3/2007 | Shevin-Sandy | F16M 11/041 248/441.1 |
| 2014/0076206 | A1 * | 3/2014 | McCabe | F16M 11/046 108/5 |
| 2018/0184797 | A1 * | 7/2018 | Chuang | A47B 9/16 |
| 2020/0375351 | A1 * | 12/2020 | Xiang | B66F 7/065 |
| 2022/0312955 | A1 * | 10/2022 | Fischer | A47B 9/16 |
| 2022/0362625 | A1 * | 11/2022 | Li | A47B 96/02 |
| 2023/0031003 | A1 * | 2/2023 | Gu | F16M 11/105 |

FOREIGN PATENT DOCUMENTS

| | | | |
|---|---|---|---|
| CN | 210433048 | * | 5/2020 |
| GB | 2563049 | * | 12/2018 |
| GB | 2575456 | * | 1/2020 |
| WO | 2021069852 | * | 4/2021 |
| WO | 2022/258418 | * | 12/2022 |

OTHER PUBLICATIONS

Height Adjustable VESA Adapter: Instruction Manual; Mar. 6, 2020; 4 pages; VIVO; Goodfield, Illinois.
SKU: DESK_V000P; Mar. 4, 2020; 1 page; VIVO; Goodfield, Illinois.
Universal Laptop Desk for Treadmill: Instruction Manual; Jun. 29, 2020; 4 pages; VIVO; Goodfield, Illinois.
Universal Laptop Stand for Treadmill: Instruction Manual; Mar. 6, 2020; 4 pages; VIVO; Goodfield, Illinois.

* cited by examiner

WORKSPACE RISER FOR EXERCISE EQUIPMENT

TECHNICAL FIELD

This disclosure relates to workspaces for mounting to exercise equipment.

BACKGROUND

Exercise equipment, such as treadmills, stair-steppers, elliptical machines, and stationary bikes, often include handlebars. Workspaces, like flat desktops, may mount to the handlebars of exercise equipment. The user may use the workspace for using a laptop, reading, writing, and performing other tasks while exercising.

BRIEF SUMMARY

As disclosed herein, an adjustable height workspace is designed to mount to handlebars of exercise equipment, such as treadmills, stair-steppers, elliptical machines and stationary bikes or other exercise equipment. Adjustable height workspaces disclosed herein include a riser mechanism, providing a user-selectable height for the workspace above the handlebars. Compared to flat workspaces, the adjustable height workspaces disclosed herein provide selectable heights to improve ergonomics for different users and a variety of exercise equipment.

In one example, an adjustable height workspace includes a base forming a bottom surface, a first handlebar mount on the bottom surface, a second handlebar mount on the bottom surface spaced from the first handlebar mount, a work surface platform, and a height adjustment mechanism connecting the work surface platform and the base. The height adjustment mechanism includes a set of pivot arms including a first pivot arm and a second pivot arm that connect at a scissoring pivot point creating a scissoring motion when raising and lowering the work surface platform to various heights, a base pivot point fixed relative to the base and connecting a first end of the first pivot arm to the base, a platform pivot point fixed relative to the work surface platform and connecting a first end of the second pivot arm to the work surface platform, a first sliding mechanism between a second end of the first pivot arm and the work surface platform, and a second sliding mechanism between a second end of the second pivot arm and the base.

In another example, an assembly includes exercise equipment including a pair of handlebars with a first handlebar and a second handlebar, and an adjustable height workspace mounted to the handlebars. The adjustable height workspace includes a base forming a bottom surface, a first handlebar mount on the bottom surface, a second handlebar mount on the bottom surface spaced from the first handlebar mount, a work surface platform, and a height adjustment mechanism connecting the work surface platform and the base. The height adjustment mechanism includes a set of pivot arms including a first pivot arm and a second pivot arm that connect at a scissoring pivot point creating a scissoring motion when raising and lowering the work surface platform to various heights, a base pivot point fixed relative to the base and connecting a first end of the first pivot arm to the base, a platform pivot point fixed relative to the work surface platform and connecting a first end of the second pivot arm to the work surface platform, a first sliding mechanism between a second end of the first pivot arm and the work surface platform, and a second sliding mechanism between a second end of the second pivot arm and the base.

DETAILED DESCRIPTION

Figure 1A:
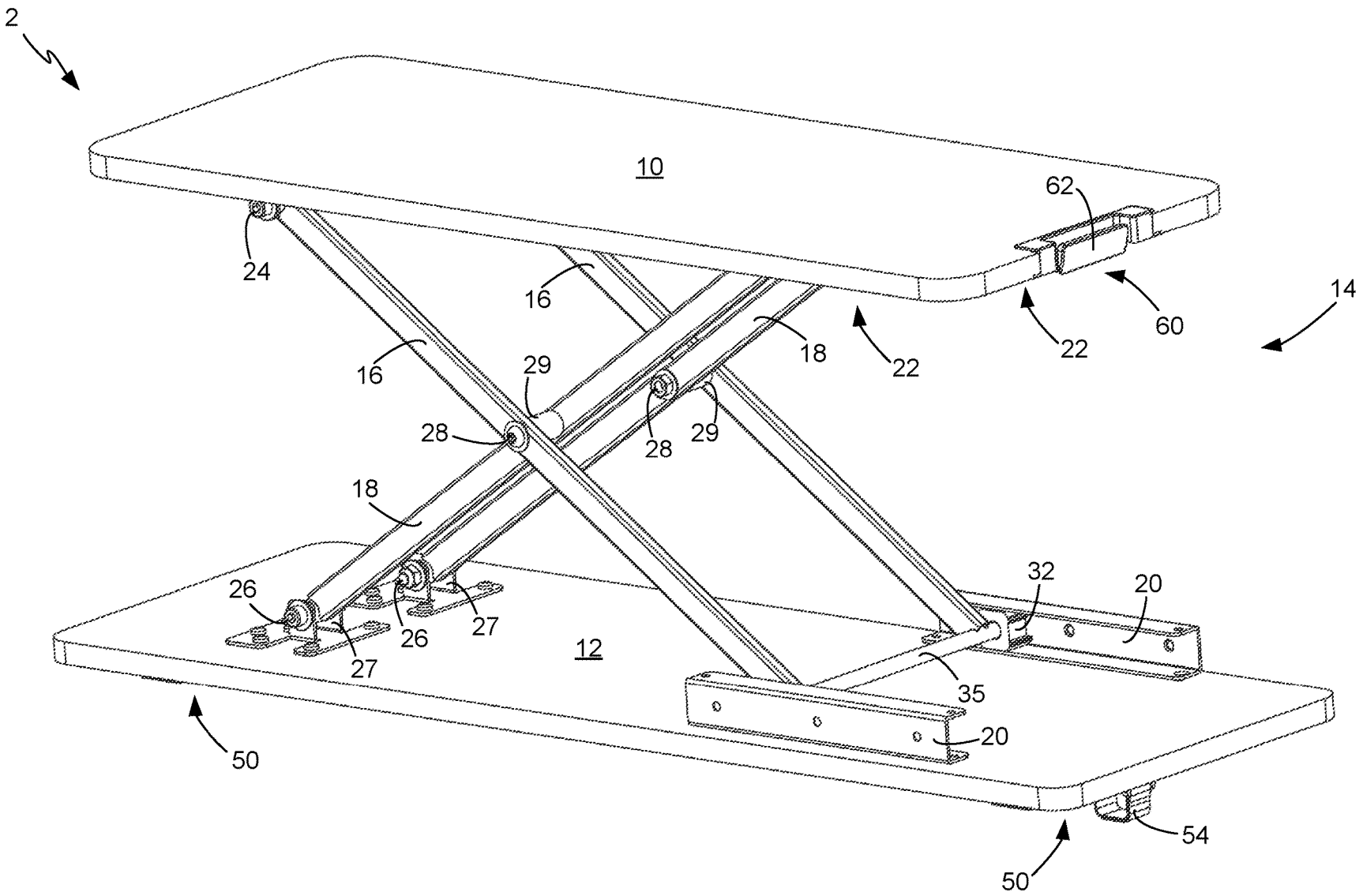
FIGS. 1A-1D illustrate an adjustable height workspace configured to mount to handlebars of exercise equipment.
Figure 1B:
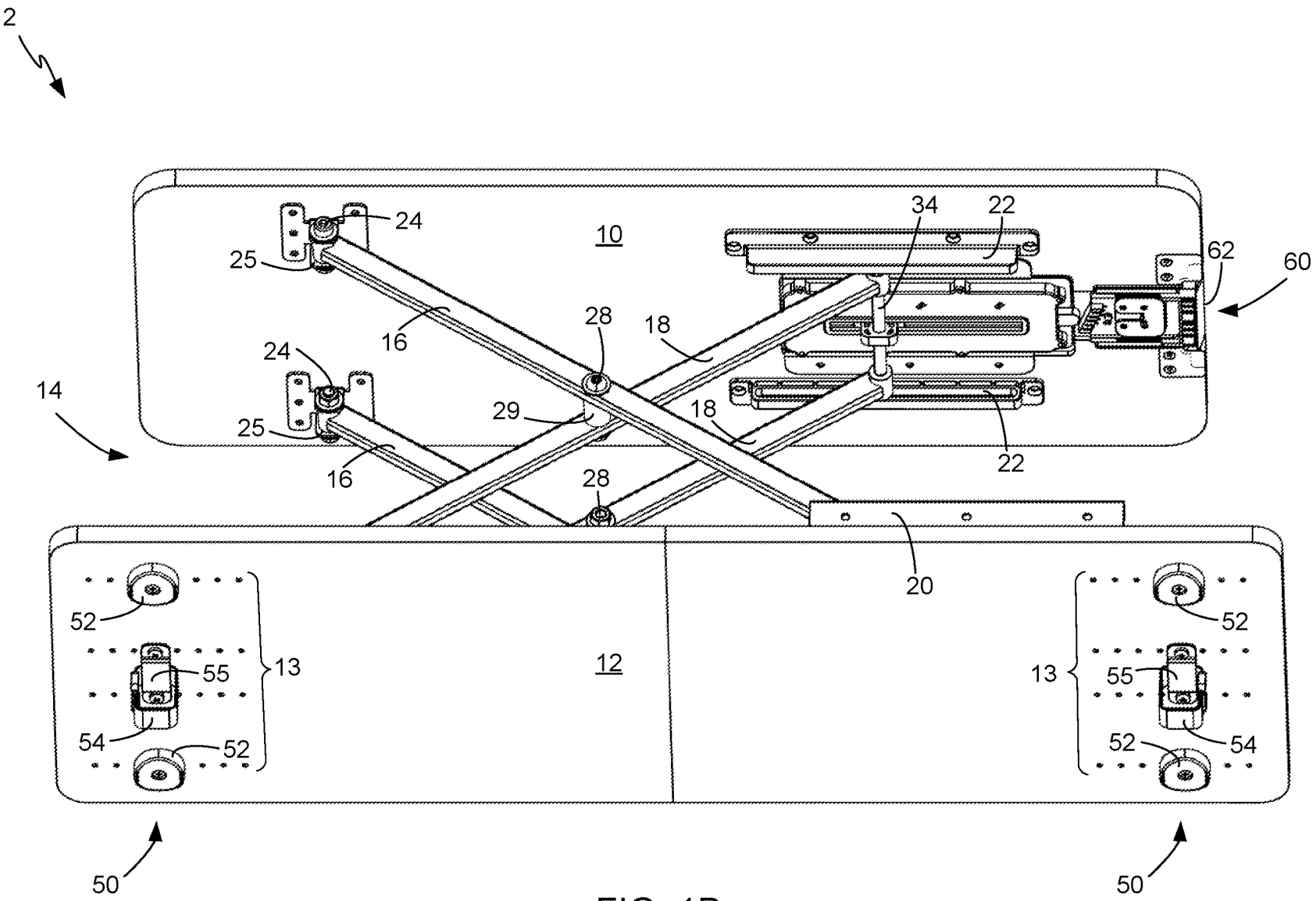
Figure 1C:
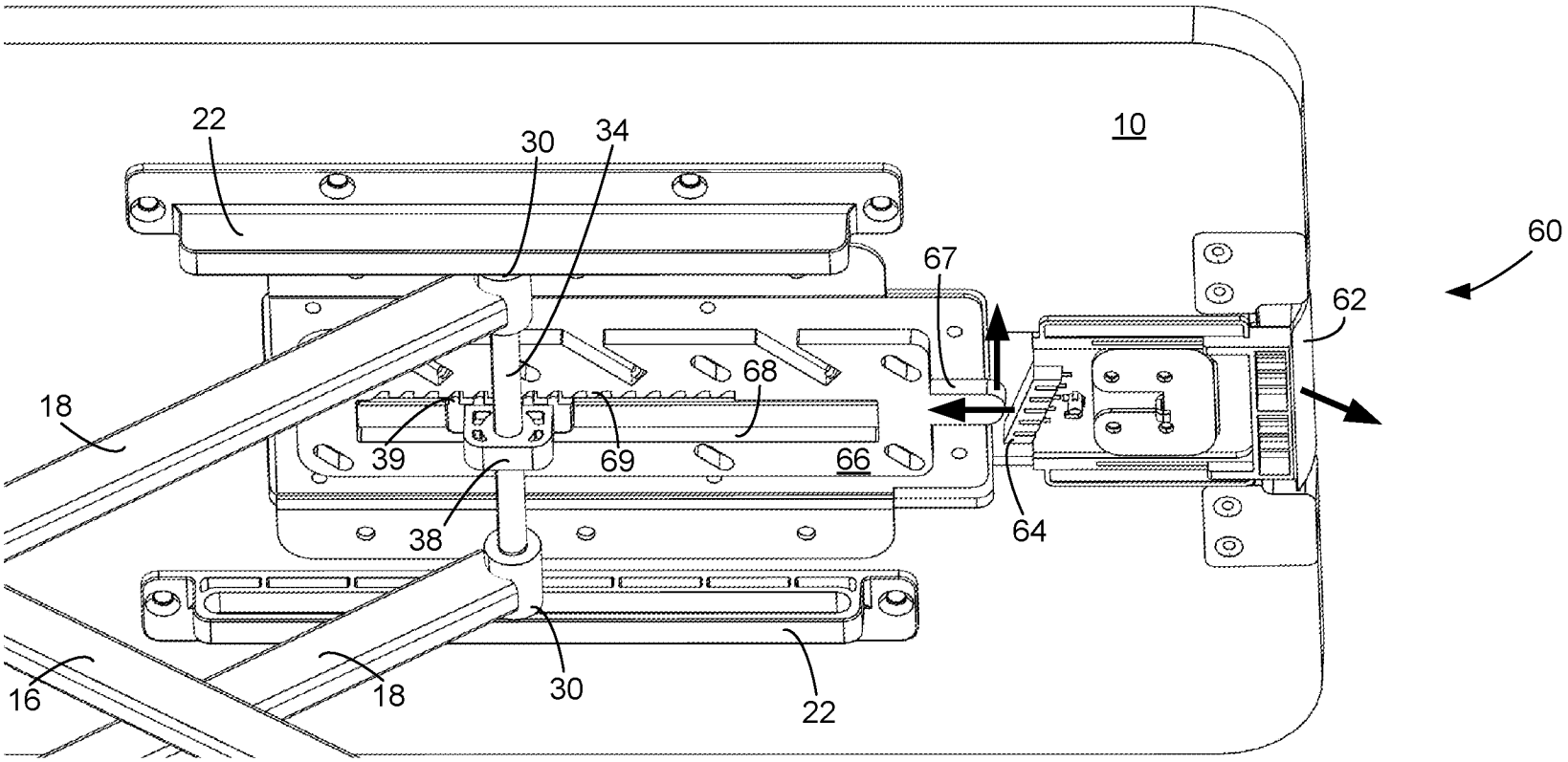
Figure 1D:
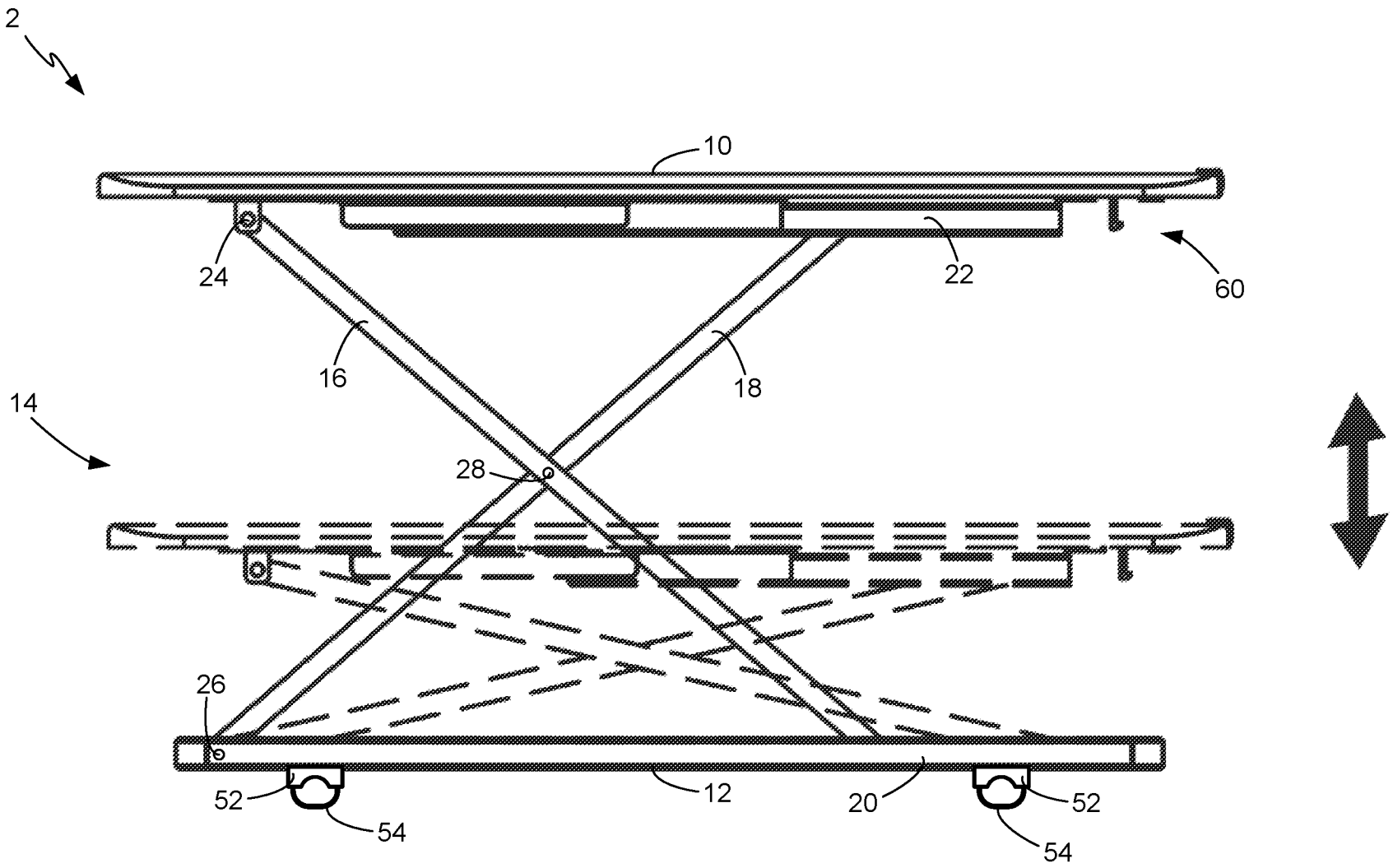

FIGS. 1A-1D illustrate an adjustable height workspace 2. Specifically, FIG. 1A illustrates a side perspective view of adjustable height workspace 2, FIG. 1B illustrates a bottom perspective view of adjustable height workspace 2, FIG. 1C illustrates a portion of adjustable height workspace 2 including locking mechanism 60, and FIG. 1D is a conceptual illustration demonstrating the motion of adjustable height workspace 2.

Adjustable height workspace 2 includes a base 12 forming a bottom surface with two handlebar mounts 50 arranged in parallel on the bottom surface. Each handlebar mount 50 includes a pair of concave pads 52 protruding from the bottom surface, and a strap 54 attached to the bottom surface between the first pair of concave pads 52. Each strap 54 is configured to attach to a handlebar of exercise equipment while holding the corresponding pair of concave pads 52 against the handlebar. In the specific example of handlebar mounts 50, each strap 54 is attached to base 12 with a strap bracket 55.

Concave pads 52 and strap brackets 55 attach to the bottom surface of base 12 with screws that engage predrilled holes. For example, base 12 may be formed from a material that deforms to accept the screws or base 12 may include threaded holes to accept the screws. In various examples, base 12 may be formed from a wood material, such as solid wood, presswood, or plywood, a plastic material, such as a molded plastic material, a metal material, such as a thin stamped metal material, or other material. The bottom surface of base includes two arrays of holes 13 providing for selective positioning of the concave pads 52 and the strap brackets 55 on the bottom surface of base 12. This allows a user to select the position of handlebar mounts 50 to account for the spacing of the handlebars on the exercise equipment.

Adjustable height workspace 2 further includes a work surface platform 10, and a height adjustment mechanism 14 connecting the work surface platform 10 and the base 12. The work surface platform 10 includes a top surface forming a workspace for a user to store and view materials while using the exercise equipment. The user may use the workspace for using a laptop, reading, writing, and performing other work while exercising. For example, the workspace could hold objects such as a laptop, monitor, tablet, keyboard, mouse, and other desk items. In various examples, work surface platform 10 may be formed from a wood material, such as solid wood, presswood, or plywood, a plastic material, such as a molded plastic material, a metal material, such as a thin stamped metal material, or other material.

The height adjustment mechanism 14 raises work surface platform 10 vertically relative to base 12 without protruding out along the horizontal plane, keeping the individual using the device from having to step backward to use the work surface platform 10 when it is in a raised position. When raised, the work surface platform 10 raises in a substantially straight motion so that it stays in-line with the base 12, as best shown in FIG. 1D. This configuration allows the operator to utilize the work surface platform at various heights without interfering with the user's use of the exercise equipment.

The height adjustment mechanism 14 includes two sets of pivot arms 16, 18 that connect at a scissoring pivot point 28, creating a scissoring motion when raising and lowering the work surface platform 10 to various heights. In the specific example of height adjustment mechanism 14, the scissoring pivot points 28 each include spacers 29 over a bolt such that the scissoring pivot arms 16, 18 are offset from one another. The two sets of pivot arms 16, 18 operate in parallel. Base pivot points 26 are fixed relative to the base 12 by brackets 27 and connect a first end of pivot arms 18 to the base 12. Similarly, platform pivot points 24 are fixed relative to the work surface platform 10 by brackets 25 and connect a first end of the pivot arms 16 to the work surface platform 10. In the illustrated examples, brackets 25, 27 form protrusions with through-holes that receive bolts forming the pivot points 24, 26.

The height adjustment mechanism 14 further includes sliding mechanisms 20 between second ends of the pivot arms 18 and the work surface platform 10. Sliding mechanisms 20 each include a track secured to an upper side of base 12. In some examples, such a track may be formed form a stamped metal secured to the upper side of base 12 with screws. Each track of sliding mechanisms 20 receives a slider 32 which is fitted over the end of crossbeam 35. Crossbeam 35 extends between the second ends of parallel arms 16, opposite pivot points 24. For example, the slider 32 may be a molded polymer component including a hole to receive the end of crossbeam 35 and with an outer profile shaped to slidably mate with the inner surfaces of the track of sliding mechanisms 20.

Similarly, the height adjustment mechanism 14 includes sliding mechanisms 22, which each form a channel that receives an end of crossbeam 34, which extends between the second ends 30 of parallel arms 18, opposite pivot points 26. Ends 30 of arms 18 include through holes and crossbeam 34 extends beyond the ends 30 of arms 18 to engage the channels of sliding mechanisms 22. In some examples, the channels of sliding mechanisms 22 may be formed by a molded plastic material sized to slidably receive the ends of crossbeam 34. The channels of sliding mechanisms 22 may be secured to the underside of work surface platform 10 with screws or by other suitable techniques. While sliding mechanisms 20 includes tracks, and sliding mechanisms 22 includes channels, in other examples, either or both of sliding mechanisms 20, 22 may include channels, tracks, wheels on the ends of the pivot arms 16, 18 or other sliding mechanisms.

Pivot arms 16, 18 align side-by-side in such a manner that when fully lowered the adjustable height workspace 2 is compact, looks sleek, and takes up minimal vertical space. The desktop workspace accomplishes such a compact state by having sliding mechanisms 20 outside arms 16, which is outside arms 18, which is sliding mechanisms 22. This arrangement of elements allows the elements to not overlap when desktop workspace that adjusts vertically is in a fully lowered position providing a substantially compact state, as best shown in FIG. 2A.

The height adjustment mechanism 14 further includes a locking mechanism 60. The locking mechanism 60 holds the work surface platform 10 at various vertical heights above the base 12. The locking mechanism 60 includes a slider 38 attached to one of the pivot arms 16, 18, and a flexible frame 66 forming a groove 68 that receives the slider 38. Specifically, the slider 38 is mounted to the crossbeam 34, which extends between the ends 30 of pivot arms 18. The flexible frame 66 includes frame teeth 69 and the slider 38 includes mating slider teeth 39, wherein the slider teeth 39 engage the frame teeth 69 to hold the pivot arms 18 in position at any of the various vertical heights above the base 12. The locking mechanism 60 further includes a handle 62 configured to flex the flexible frame 66 and disengage the slider teeth 39 from the frame teeth 69 thereby allowing repositioning of the work surface platform 10 at the various vertical heights above the base 12. As shown in FIG. 1C, pulling on handle 62 actuates angled surface 64 to act upon tab 67 to flex the flexible frame 66 and disengage the slider teeth 39 from the frame teeth 69.

Figure 2A:
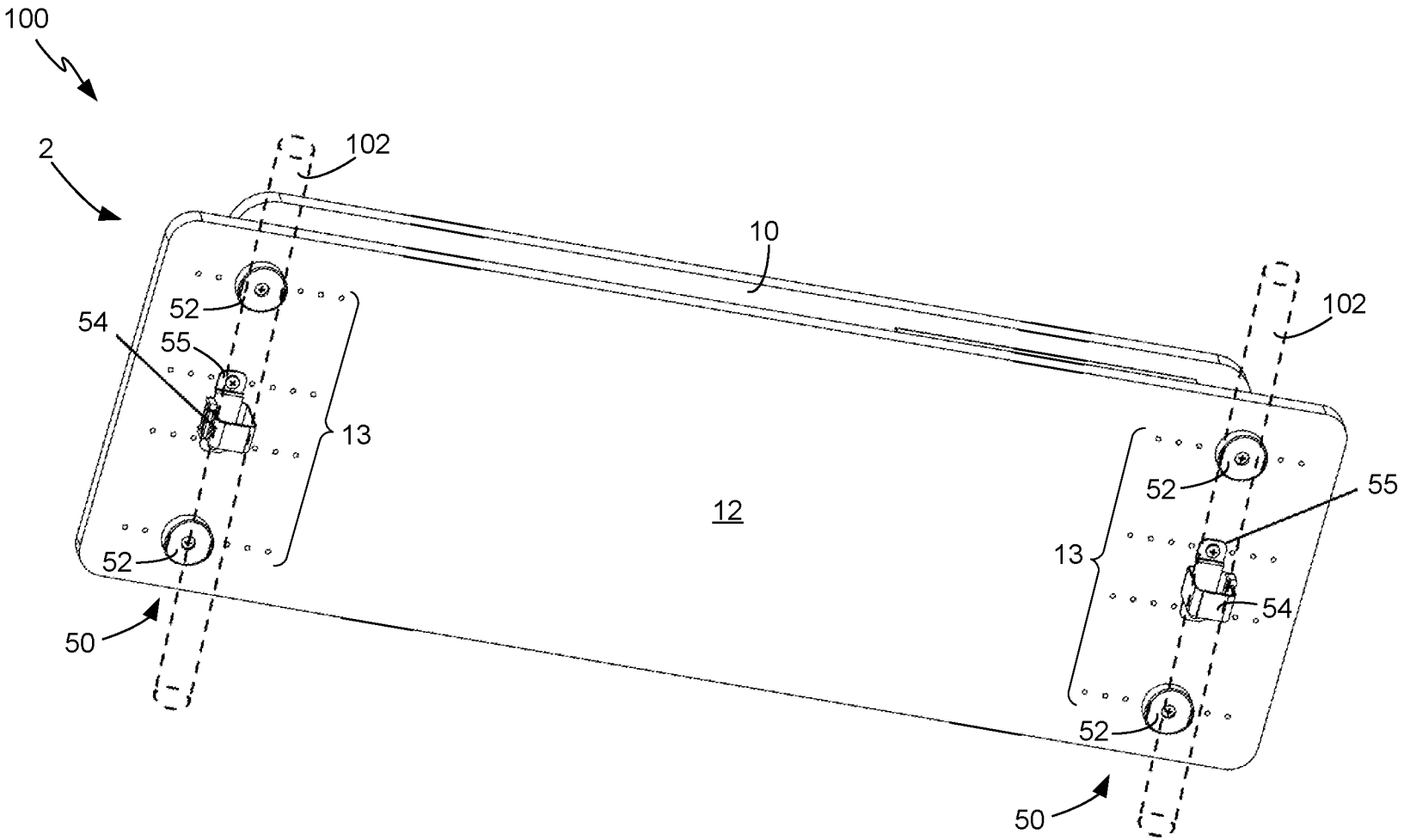
FIGS. 2A and 2B illustrate an assembly including the adjustable height workspace of FIGS. 1A-1D mounted to handlebars of exercise equipment.
Figure 2B:
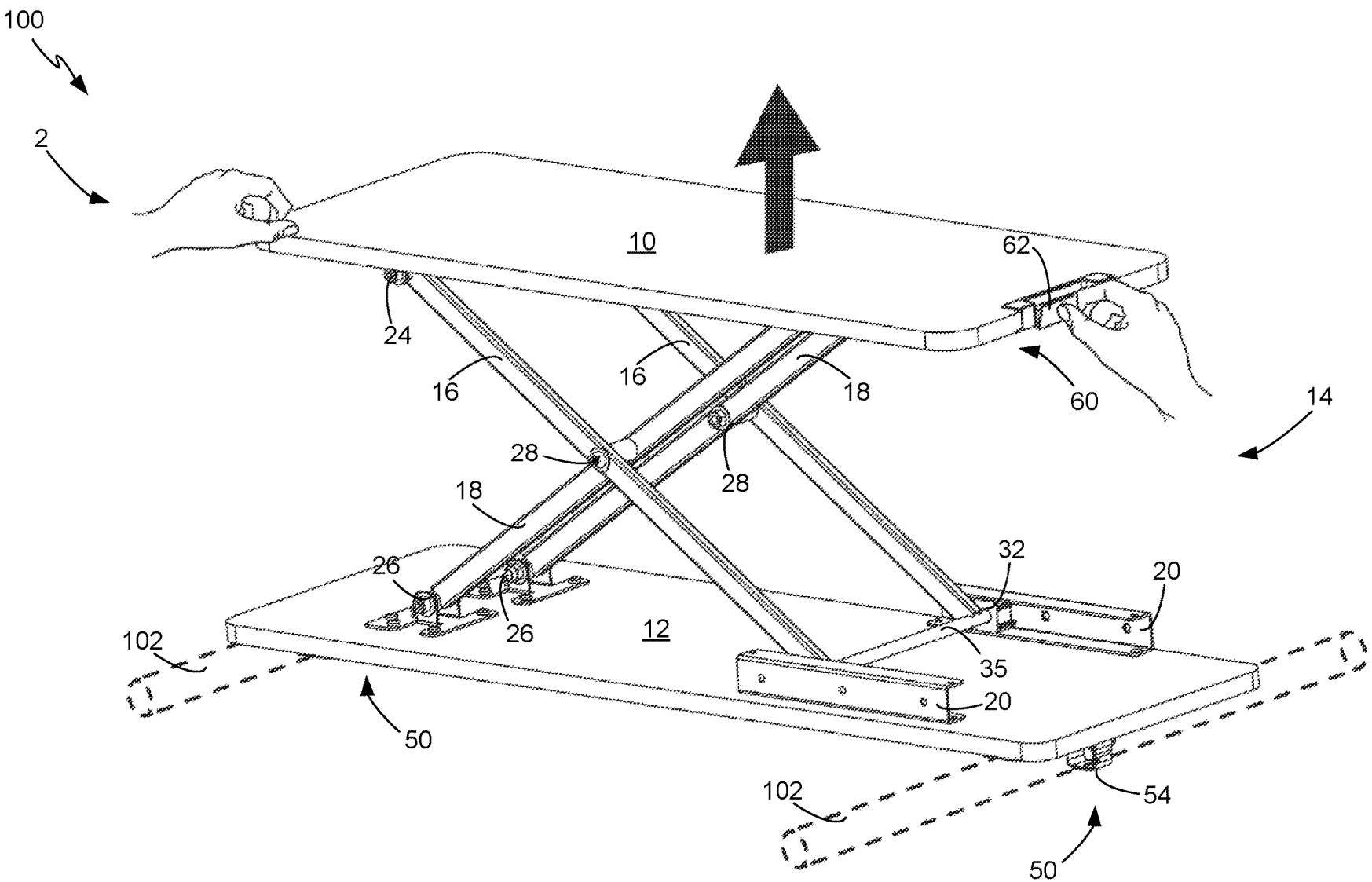

As shown in FIGS. 2A and 2B adjustable height workspace 2 mounted to handlebars 102 of exercise equipment to form an assembly 100. Prior to mounting adjustable height workspace 2 to handlebars 102, the positions of handlebar mounts 50 are selected to correspond between the spacing of handlebars 102 of the exercise equipment. Specifically, an installer may align the base 12 to the handlebars 102 and select holes within the two arrays of holes 13 for installing concave pads 52 and strap brackets 55.

Figure 3:
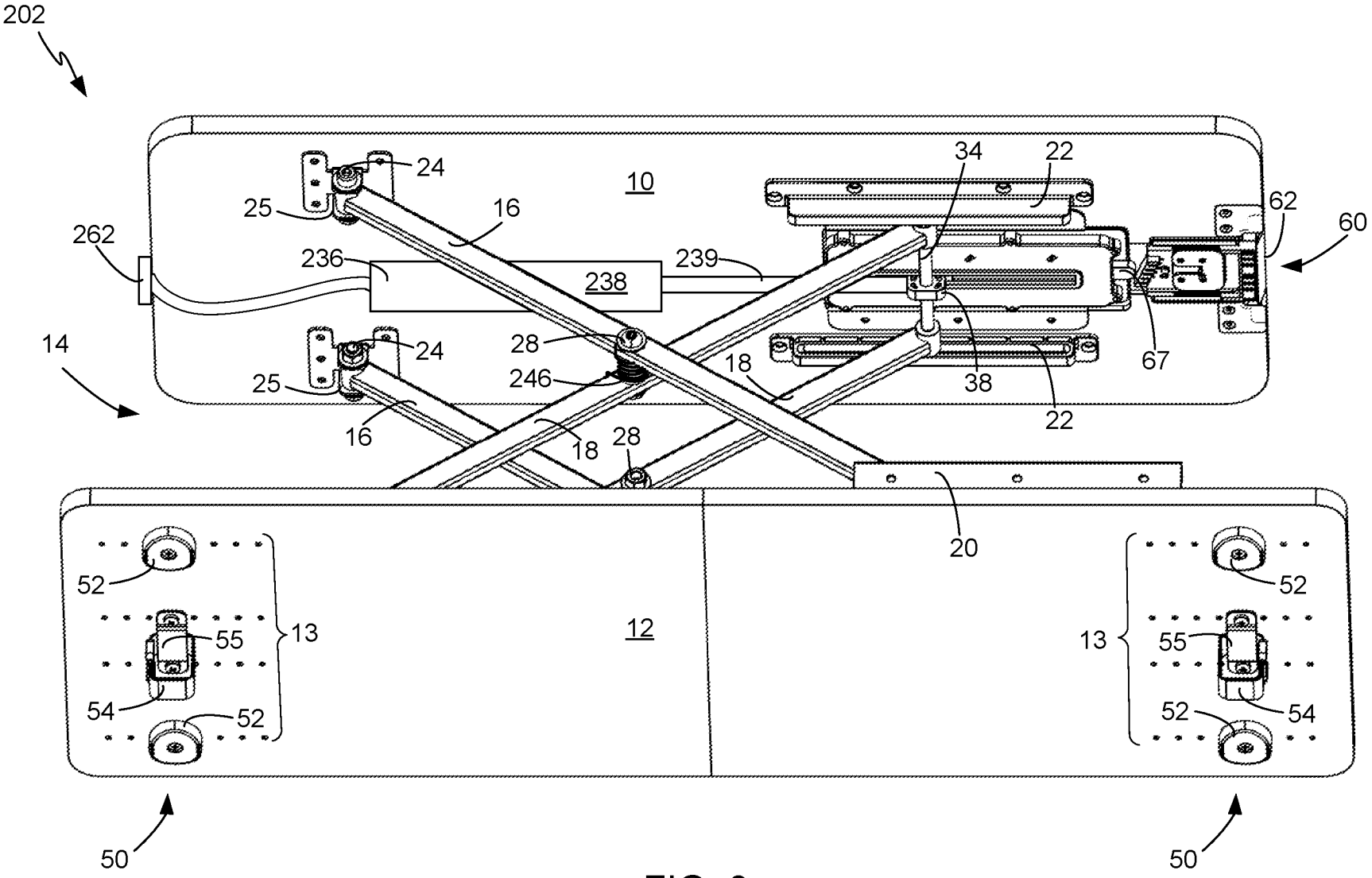
FIG. 3 illustrates an adjustable height workspace configured to mount to handlebars of exercise equipment, the adjustable height workspace including springs to assist in elevation of the work surface platform.

FIG. 3 illustrates an adjustable height workspace 202. Adjustable height workspace 202 is substantially similar to adjustable height workspace 2 with the addition of two optional springs 236, 246. Springs 236, 246 are configured to provide a force to assist in elevation of the work surface platform 10. The other components of adjustable height workspace 202 are the same as adjustable height workspace 2. For brevity, details regarding components already described with respect to adjustable height workspace 2 are not repeated with respect to adjustable height workspace 202.

Adjustable height workspace 202 includes a base 12 forming a bottom surface with two handlebar mounts 50 arranged in parallel on the bottom surface. Adjustable height workspace 202 further includes a work surface platform 10, and a height adjustment mechanism 14 connecting the work surface platform 10 and the base 12.

Spring 236 is a gas spring configured to provide a force to assist in elevation of the work surface platform 10. In other examples, spring 236 may be a coil spring, other spring, or linear actuator. One end of spring 236 is connected to an underside of work surface platform 10, whereas the other end of spring 236 is connected to crossbeam 34 to apply the force to assist in elevation of the work surface platform 10. In the specific example of adjustable height workspace 202, gas spring cylinder 238 is connected to an underside of work surface platform 10, while gas spring piston rod 239 is connected to crossbeam 34.

In some examples, gas spring 236 functions as a locking mechanism to hold the work surface platform 10 at various vertical heights above the base 12. As shown, adjustable height workspace 202 further comprises a gas spring control handle 262 allowing a user to selectively release the gas spring 236 to facilitate adjustment between the various vertical heights above the base 12. In such examples, locking mechanism 60 may not be included in adjustable height workspace 202, as gas spring 236 may hold the work surface platform 10 at various vertical heights above the base 12 by itself.

Spring 246 is a torsion spring configured to provide a force to assist in elevation of the work surface platform 10. Torsion spring 246 mounted between a pivot arm 18 and a pivot arm 16 at the scissoring pivot point 28 over spacer 29. In some examples, adjustable height workspace 202 may include two torsion springs 246, one for each scissoring pivot point 28 over each spacer 29.

Springs 236, 246 are optional and various examples of adjustable height workspace 202 may include any combination of springs 236, 246, such as a single spring or three or more springs. Other configurations of springs and/or actuators to apply a force to assist in elevation of the work surface platform 10 are also possible.

Figure 4A:
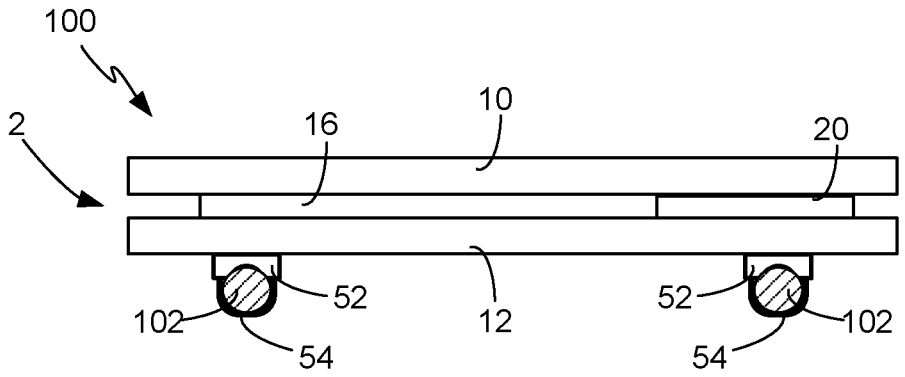
FIGS. 4A-4C illustrate adjustable height workspaces having various handlebar mounts mounted handlebars of exercise equipment.
Figure 4B:
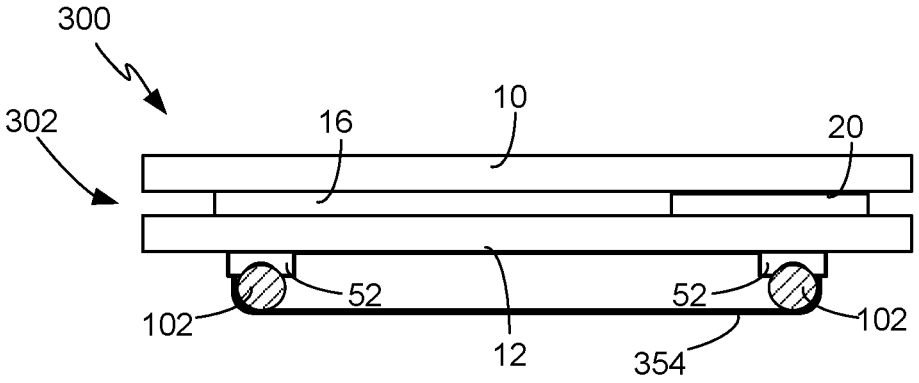
Figure 4C:
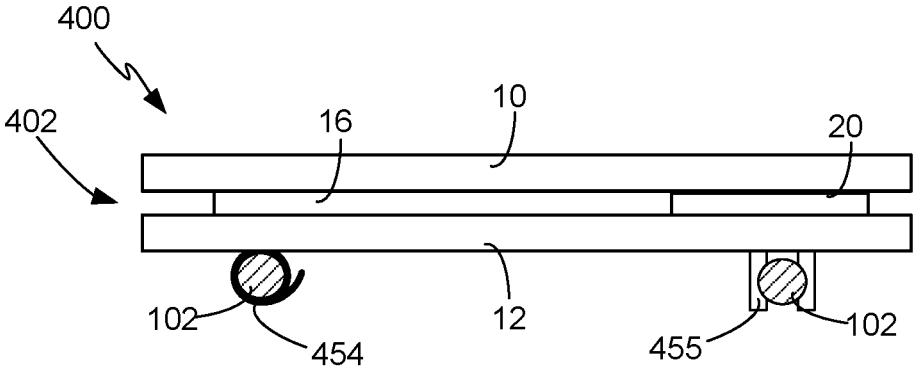

FIGS. 4A-4C illustrate adjustable height workspaces having various handlebar mounts mounted handlebars of exercise equipment. Specifically, FIG. 4A illustrates assembly 100 including adjustable height workspace 2 in a fully collapsed configuration and mounted to handlebars 102. As shown in in FIG. 4A, straps 54 attach to the handlebars 102 and hold the handlebars against the concave pads 52.

FIG. 4B illustrates an assembly 300 including adjustable height workspace 302 in a fully collapsed configuration and mounted to handlebars 102. Adjustable height workspace 302 is substantially similar to adjustable height workspace 2 except that the two straps 54 have been replaced with a common strap 354 that simultaneously engages both handlebars 102. The other components of adjustable height workspace 302 are the same as adjustable height workspace 2. For brevity, details regarding components already described with respect to adjustable height workspace 2 are not repeated with respect to adjustable height workspace 302.

FIG. 4C illustrates an assembly 400 including adjustable height workspace 402 in a fully collapsed configuration and mounted to handlebars 102. Adjustable height workspace 402 is substantially similar to adjustable height workspace 2 except that the two straps 54 have been replaced with a ring clamp 454 that engages one handlebar 102 and a pinching clamp 455 that engages the other handlebar 102. The other components of adjustable height workspace 402 are the same as adjustable height workspace 2. For brevity, details regarding components already described with respect to adjustable height workspace 2 are not repeated with respect to adjustable height workspace 402.

Straps 54, common strap 354, ring clamp 454, and pinching clamp 455, represent example handlebar mounts that may be used on the bottom surface of base 12 to engage the handlebars of exercise equipment. Other handlebar mounts may also be used. The described handlebar mounts and other handlebar mounts be used in any combination, with or without pads, such as concave pads 52, to secure an adjustable height workspace to the handlebars of exercise equipment.

The specific techniques for adjustable height workspaces handlebar mounts including techniques described with respect to adjustable height workspaces 2, 202 are merely illustrative of the general inventive concepts included in this disclosure as defined by the following claims.

What is claimed is:

1. An adjustable height workspace comprising:

a base;

a work surface platform;

a height adjustment mechanism connecting the work surface platform and the base, the height adjustment mechanism including:

a set of pivot arms including a first pivot arm and a second pivot arm that connect at a scissoring pivot point creating a scissoring motion when raising and lowering the work surface platform to various heights;

a base pivot point fixed relative to the base and connecting a first end of the first pivot arm to the base;

a platform pivot point fixed relative to the work surface platform and connecting a first end of the second pivot arm to the work surface platform;

a first sliding mechanism between a second end of the first pivot arm and the work surface platform; and a second sliding mechanism between a second end of the second pivot arm and the base; and a locking mechanism that holds the work surface platform at various vertical heights above the base, wherein the locking mechanism includes:

a slider attached to one of the pivot arms; and a flexible frame forming a groove that receives the slider, wherein the flexible frame includes frame teeth and the slider includes mating slider teeth, wherein the slider teeth engage the frame teeth to hold the one of the pivot arms in position at any of the various vertical heights above the base.

2. The adjustable height workspace of claim 1, wherein the first sliding mechanism includes a channel or track mounted to the work surface platform.

3. The adjustable height workspace of claim 2, wherein the second sliding mechanism includes a channel or track mounted to the base.

4. The adjustable height workspace of claim 1, further comprising a spring configured to provide a force to assist in elevation of the work surface platform.

5. The adjustable height workspace of claim 4, wherein the set of pivot arms is a first set of pivot arms, the adjustable height workspace further comprising:

a second set of pivot arms that operate in parallel to the first set of pivot arms; and an element extending between the first set of pivot arms and the second set of pivot arms, wherein the spring is connected to the element.

6. The adjustable height workspace of claim 4, wherein the spring extends between the work surface platform and the set of pivot arms.

7. The adjustable height workspace of claim 4, wherein the spring is a gas spring.

8. The adjustable height workspace of claim 7, wherein the locking mechanism is a first locking mechanism, wherein the gas spring functions as a second locking mechanism to hold the work surface platform at various vertical heights above the base, and wherein the adjustable height workspace further comprises a gas spring control handle allowing a user to selectively release the gas spring to facilitate adjustment between the various vertical heights above the base.

9. The adjustable height workspace of claim 4, wherein the spring is a torsion spring mounted between the first pivot arm and the second pivot arm at the scissoring pivot point.

10. The adjustable height workspace of claim 1, wherein the locking mechanism further includes a handle configured to flex the flexible frame and disengage the slider teeth from the frame teeth thereby allowing repositioning of the work surface platform at the various vertical heights above the base.

11. The adjustable height workspace of claim 1, wherein the set of pivot arms is a first set of pivot arms, the adjustable height workspace further comprising:

a second set of pivot arms that operate in parallel to the first set of pivot arms; and an element extending between the first set of pivot arms and the second set of pivot arms, wherein the slider is mounted to the element.

12. The adjustable height workspace of claim 1, further comprising:

a first handlebar mount on a bottom surface of the base, wherein the first handlebar mount includes:

a first pair of concave pads protruding from the bottom surface, and a first strap extending below the bottom surface, wherein the first strap is configured to attach to a first handlebar to hold the first handlebar against one of the first pair of concave pads;

a second handlebar mount on the bottom surface spaced from the first handlebar mount, wherein the second handlebar mount includes:

a second pair of concave pads protruding from the bottom surface, and a second strap extending below the bottom surface, wherein the second strap is configured to attach to a second handlebar to hold the second handlebar against one of the second pair of concave pads.

13. The adjustable height workspace of claim 12, wherein the first and second handlebar mounts include one or more a group consisting of:

a pinching clamp;

a ring clamp;

a strap; and a common strap configured to simultaneously engage a first handlebar and a second handlebar of exercise equipment.

14. The adjustable height workspace of claim 12, wherein the first strap is attached to the bottom surface between the first pair of concave pads, wherein the first strap is configured to attach to a first handlebar to hold the first handlebar against both of the first pair of concave pads, and wherein the second strap is attached to the bottom surface between the second pair of concave pads, wherein the second strap is configured to attach to a second handlebar to hold the second handlebar against both of the second pair of concave pads.

15. An adjustable height workspace comprising:

a base forming a bottom surface;

a first handlebar mount on the bottom surface;

a second handlebar mount on the bottom surface spaced from the first handlebar mount;

a work surface platform;

a height adjustment mechanism connecting the work surface platform and the base, the height adjustment mechanism including:

a set of pivot arms including a first pivot arm and a second pivot arm that connect at a scissoring pivot point creating a scissoring motion when raising and lowering the work surface platform to various heights;

a base pivot point fixed relative to the base and connecting a first end of the first pivot arm to the base;

a platform pivot point fixed relative to the work surface platform and connecting a first end of the second pivot arm to the work surface platform;

a first sliding mechanism between a second end of the first pivot arm and the work surface platform; and a second sliding mechanism between a second end of the second pivot arm and the base; and a locking mechanism that holds the work surface platform at various vertical heights above the base, wherein the locking mechanism includes:

a slider attached to one of the pivot arms; and a flexible frame forming a groove that receives the slider, wherein the flexible frame includes frame teeth and the slider includes mating slider teeth, wherein the slider teeth engage the frame teeth to hold the one of the pivot arms in position at any of the various vertical heights above the base.

16. The adjustable height workspace of claim 15, wherein the locking mechanism further includes a handle configured to flex the flexible frame and disengage the slider teeth from the frame teeth thereby allowing repositioning of the work surface platform at the various vertical heights above the base.

17. The adjustable height workspace of claim 15, wherein the set of pivot arms is a first set of pivot arms, the adjustable height workspace further comprising:

a second set of pivot arms that operate in parallel to the first set of pivot arms; and an element extending between the first set of pivot arms and the second set of pivot arms, wherein the slider is mounted to the element.

18. The adjustable height workspace of claim 15, wherein the bottom surface includes a first array of holes providing for selective positioning of the first handlebar mount on the bottom surface, and wherein the bottom surface includes a second array of holes providing for selective positioning of the second handlebar mount on the bottom surface.

19. An assembly comprising:

exercise equipment including a pair of handlebars with a first handlebar and a second handlebar; and an adjustable height workspace mounted to the handlebars, the adjustable height workspace comprising:

a base forming a bottom surface;

a first handlebar mount on the bottom surface and engaging the first handlebar;

a second handlebar mount on the bottom surface and engaging the second handlebar;

a work surface platform;

a height adjustment mechanism connecting the work surface platform and the base, the height adjustment mechanism including:

a set of pivot arms including a first pivot arm and a second pivot arm that connect at a scissoring pivot point creating a scissoring motion when raising and lowering the work surface platform to various heights;

a base pivot point fixed relative to the base and connecting a first end of the first pivot arm to the base;

a platform pivot point fixed relative to the work surface platform and connecting a first end of the second pivot arm to the work surface platform;

a first sliding mechanism between a second end of the first pivot arm and the work surface platform; and a second sliding mechanism between a second end of the second pivot arm and the base; and a locking mechanism that holds the work surface platform at various vertical heights above the base, wherein the locking mechanism includes:

a slider attached to one of the pivot arms; and a flexible frame forming a groove that receives the slider, wherein the flexible frame includes frame teeth and the slider includes mating slider teeth, wherein the slider teeth engage the frame teeth to hold the one of the pivot arms in position at any of the various vertical heights above the base.

20. The assembly of claim 19, wherein the first and second handlebar mounts include one or more a group consisting of:

a pinching clamp;

a ring clamp;

a strap; and a common strap configured to simultaneously engage a first handlebar and a second handlebar of the exercise equipment.

21. The assembly of claim 19, further comprising a spring configured to provide a force to assist in elevation of the work surface platform.

22. The assembly of claim 21, wherein the locking mechanism is a first locking mechanism, wherein the spring is a gas spring, wherein the gas spring functions as a second locking mechanism to hold the work surface platform at various vertical heights above the base, and wherein the adjustable height workspace further comprises a gas spring control handle allowing a user to selectively release the gas spring to facilitate adjustment between the various vertical heights above the base.

23. The assembly of claim 21, wherein the spring is a torsion spring mounted between the first pivot arm and the second pivot arm at the scissoring pivot point.

24. The assembly of claim 19, wherein the first handlebar mount includes:

a first pair of concave pads protruding from the bottom surface, and a first strap extending below the bottom surface and holding the first handlebar against one of the first pair of concave pads, and wherein the second handlebar mount includes:

a second pair of concave pads protruding from the bottom surface, and a second strap extending below the bottom surface and holding the second handlebar against one of the second pair of concave pads.

25. The assembly of claim 24, wherein the first strap is attached to the bottom surface between the first pair of concave pads, wherein the first strap engages the first handlebar and holds the first handlebar against both of the first pair of concave pads, and wherein the second strap is attached to the bottom surface between the second pair of concave pads, wherein the second strap engages the second handlebar and holds the second handlebar against both of the second pair of concave pads.

* * * * *